US005092279A

United States Patent [19]

Barmore

[11] Patent Number: 5,092,279

[45] Date of Patent: Mar. 3, 1992

[54] DISTRIBUTION BAFFLE FOR HOT WATER TANK

[75] Inventor: Thomas J. Barmore, Edmonds, Wash.

[73] Assignee: General Electric Company, Cincinnati, Ohio

[21] Appl. No.: 674,842

[22] Filed: Mar. 25, 1991

[51] Int. Cl.[5] ..... F22B 5/00

[52] U.S. Cl. ..... 122/13.1; 122/13.2; 122/408.1; 126/362

[58] Field of Search ..... 122/13.1, 13.2, 408.1, 122/451 R, 406.1, 408.2; 126/361, 362

[56] References Cited

U.S. PATENT DOCUMENTS

| | | | |
|---|---|---|---|
| 2,644,432 | 7/1953 | Hummel | 122/13 |
| 2,708,914 | 5/1955 | Cooper | 122/13 |
| 2,809,267 | 10/1957 | Schauer | 219/38 |
| 3,465,123 | 9/1969 | Harris | 219/328 |
| 4,037,569 | 6/1977 | Bennett et al. | 122/32 |
| 4,257,355 | 3/1981 | Cook | 122/17 |
| 4,838,211 | 6/1989 | Vago | 122/159 |
| 4,949,680 | 8/1990 | Kale | 122/13.1 |

*Primary Examiner*—Edward G. Favors

*Attorney, Agent, or Firm*—James P. Davidson; Jerome C. Squillaro

[57] ABSTRACT

A hot water tank for heating water which includes means for transforming a high velocity jet of incoming cold water at the inlet of the tank to a piston for forcing hot water accumulated in the upper portion of the tank through the outlet, whereby turbulent mixing between the incoming cold water and the accumulated hot water is minimized.

6 Claims, 3 Drawing Sheets

DISTRIBUTION BAFFLE FOR HOT WATER TANK

BACKGROUND OF THE INVENTION

1. Field of the Invention

The present invention relates to a hot water tank for heating water, and, more particularly, to a hot water tank for heating water which includes means for transforming a high velocity jet of incoming cold water at the inlet of the tank to a low velocity-high volume flow or piston for forcing hot water accumulated in the upper portion of the tank through the outlet, whereby turbulent mixing between the incoming cold water and the accumulated hot water is minimized and outlet water mixing can be precisely set.

2. Description of Related Art

In any hot water heating system, the heated hot water is forced out of the heating container by the displacement of that hot water by inlet cold water. With respect to smaller tanks (on the order of 1.5 liters), this introduction of cold water causes turbulent mixing between the cold water and hot water, where the end result is that water neither hot nor cold (but at a temperature therebetween) is provided at the outlet. Ideally, the hot water should be forced out of the tank by a "piston" of cold water, which is defined as a low velocity-high volume flow of water under fluid pressure that emanates from the bottom of the tank to the top.

While there are several references in the art which disclose designs for water heaters that combat the effects of sediment in the bottom of the tank (e.g., U.S. Pat. No. 4,838,211 to Vago and U.S. Pat. No. 4,257,355 to Cook), there has been relatively little done to minimize the turbulent mixing of cold water and hot water stemming from the introduction of cold water into the tank. U.S. Pat. No. 2,644,432 to Hummel, however, discloses a hot water tank having a horizontal orientation which includes a first baffle positioned above the inlet to cause water directed across the tank to spread laterally and spill out from under deflecting plates attached to each side of the baffle, as well as a second baffle partition which extends substantially horizontally across the tank to divide it into upper and lower sections. The second baffle partition allows communication between the upper and lower sections of the tank through either a single opening or a plurality of grouped holes or openings arranged at one end of the tank remote from the water inlet. It should be understood that while U.S. Pat. No. 2,644,432 has an object similar to that of the present invention, the prevention of free circulation between cold water entering at the inlet of the bottom of the tank and hot water in the upper portion thereof, the baffle design in the '432 patent is very crude and relies principally upon the first baffle to reduce turbulent mixing caused by the incoming water. Thereafter, water is allowed to rise in the tank and through the second baffle partition in a general convection flow as it is heated.

Accordingly, a primary objective of the present invention is to provide a hot water tank which includes means for transforming a high velocity jet of incoming cold water at the inlet of the tank to a piston for forcing hot water accumulated in the upper portion of the tank through the outlet.

Another objective of the present invention is to provide a bypass means for allowing a portion of the inlet cold water jet to be routed to a mixing orifice and mixed with outgoing hot water to increase the actual volume of hot water exiting the tank.

A further objective of the present invention is to minimize the variance in water temperature at the outlet of the hot water tank.

Still another objective of the present invention is to provide a distribution baffle which transforms a high velocity water jet introduced at its inlet side to a low velocity-high volume flow on its outlet side.

Yet another objective of the present invention is to provide means for attaching the distribution baffle in the hot water tank so as to satisfy Food & Drug Administration and National Sanitation Foundation regulations.

These objectives and other features of the present invention will become more readily apparent upon reference to the following description when taken in conjunction with the following drawing.

SUMMARY OF THE INVENTION

A hot water tank for heating water which includes means for transforming a high velocity jet of incoming cold water at the inlet of the tank to a piston for forcing hot water accumulated in the upper portion of the tank through the outlet, whereby turbulent mixing between the incoming cold water and the accumulated hot water is minimized.

BRIEF DESCRIPTION OF THE DRAWING

While the specification concludes with claims particularly pointing out and distinctly claiming the present invention, it is believed that the same will be better understood from the following description taken in conjunction with the accompanying drawing in which:

DETAILED DESCRIPTION OF THE INVENTION

Figure 1:
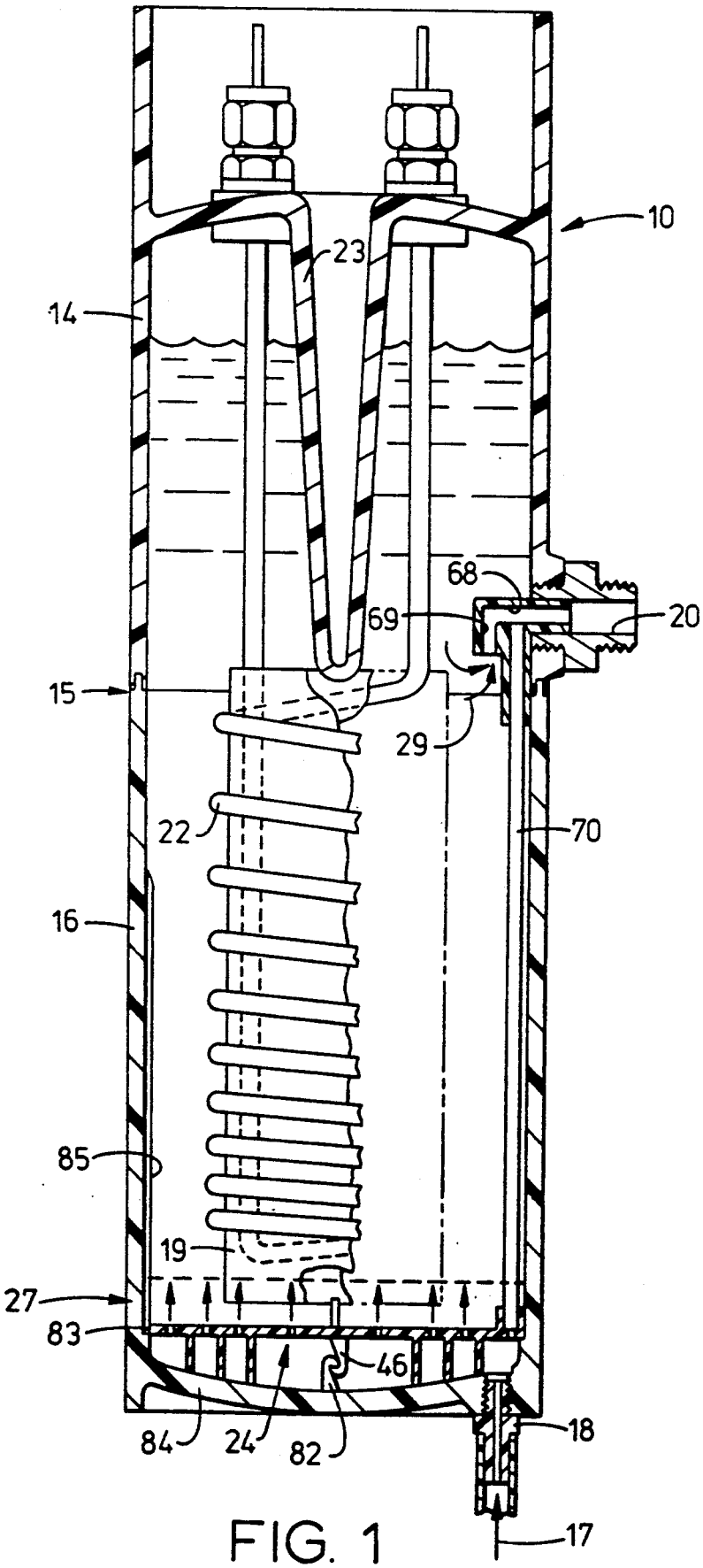
FIG. 1 is a schematic sectional view of a hot water tank exemplary of the present invention, wherein part of the view depicts the interior heating element of the tank and part of the view depicts the flow of water occurring in the tank.
Figure 2:
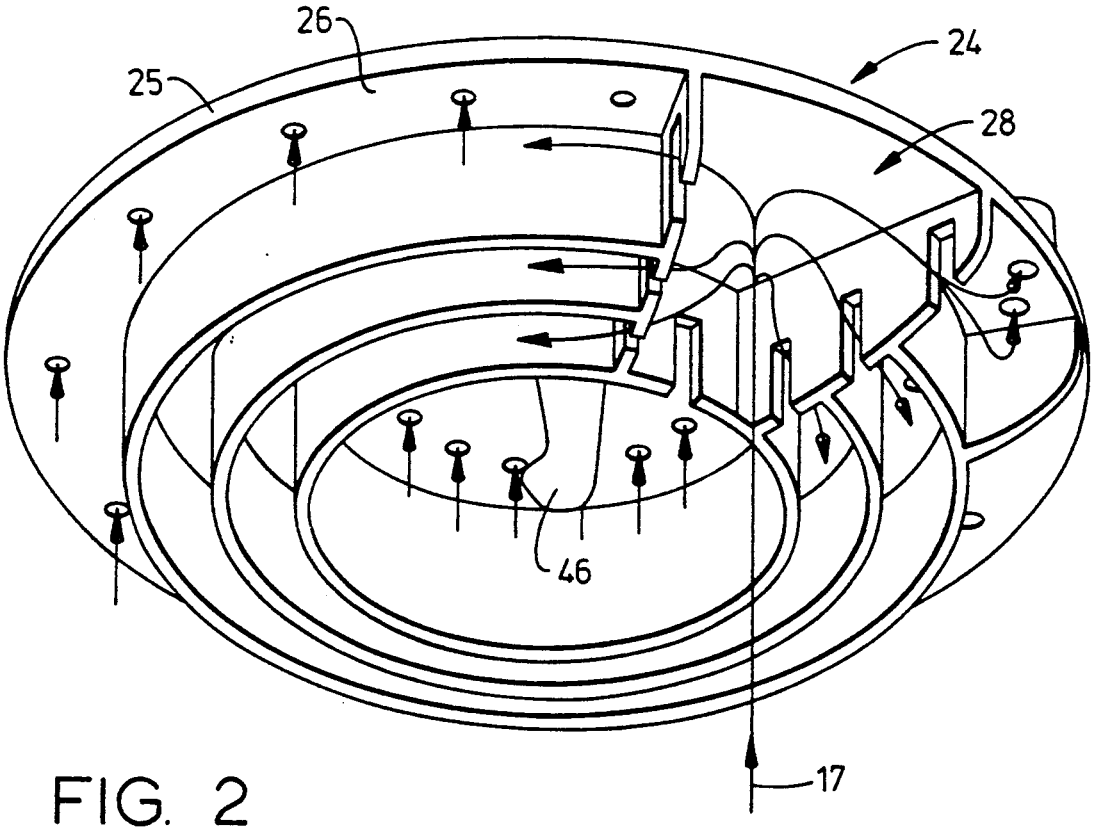
FIG. 2 is a perspective view of the distribution baffle utilized in the hot water tank of FIG. 1 for transforming a high velocity jet of incoming cold water into a piston.
Figure 5:
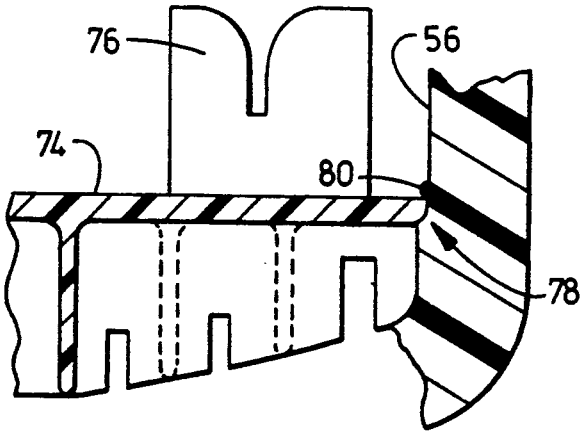
FIG. 5 is a partial cross-sectional view of FIG. 3 taken along line 5—5 depicting the attachment of the distribution baffle side edge to the interior wall of the hot water tank.

Referring now to the drawings in detail, wherein identical numerals indicate the same elements throughout the Figures, FIG. 1 depicts a hot water tank 10 of the type suitable for use in heating lavatory water for commercial aircraft. As such, hot water tank 10 is sized to hold approximately 1.5 liters of water. Hot water tank 10 comprises a generally cylindrical shell having an upper section 14 and a lower section 16, which is preferably fitted together in a tongue-and-groove arrangement shown generally at 15. It will be understood that an inlet 18 is provided in the bottom of hot water tank 10 for the introduction of a cold water jet 17, and an outlet 20 is provided in upper section 14 whereby hot water may be supplied for its intended use. A heating element 22 winds about heater tube 19 in a helical design, as depicted in FIG. 1, to heat water in tank 10. Heating element 22 is controlled by a control means (not shown) that receives temperature readings from sensor well 23, but does not comprise a part of the present invention.

A generally disk-shaped distribution baffle 24 is shown schematically in FIG. 1, but may be better seen in FIGS. 2–5. In operation, distribution baffle 24 receives a jet 17 of cold water on its inlet side 26 and transforms this high velocity (approximately 28 inches per second) jet 17 of cold water into a low velocity (approximately 0.18 inches per second) -high volume cold water "piston" 27 (see FIG. 1) which is utilized to force hot water 29 from upper section 14 of tank 10 through a mixing orifice 68 and subsequently outlet 20. Distribution baffle 24 has a disk-shaped center body 25 with an inlet side 26 and an outlet side 74 (see FIG. 4). Inlet side 26 preferably includes an inlet chamber 28 which receives high velocity cold water jet 17 from inlet 18. Inlet chamber 28 is comprised of inlet side 26 of distribution baffle 24, a pair of sidewalls 30 and 32, and a center wall 34. It will be seen in FIG. 3 that slots 35–41 are provided in sidewalls 30 and 32 and center wall 34, thereby allowing flow communication from inlet chamber 28 to a plurality of distribution chambers.

A center distribution chamber 42 is provided in the center of inlet side 26 of distribution baffle 24 and is substantially circular in shape. Center distribution chamber 42 includes a plurality of openings 44 in center body 25 of distribution baffle 24 so as to allow flow communication therethrough. While openings 44 in center distribution chamber 42 may be arranged in any number of ways, they preferably will be spaced equidistantly in a substantially circular arrangement. It will be noted that no such opening is provided in direct alignment with slot 38 of center wall 34 (which allows flow communication from inlet chamber 28 to center distribution chamber 42). This is because such an opening in this location would receive a higher pressure, and consequently more flow than desirable. Additionally, a hook 46 extends from inlet side 26 of distribution baffle 24 substantially in the middle of center distribution chamber 42. Hook 46 will be described in further detail hereinafter when describing the way in which distribution baffle 24 is affixed within tank 10.

Figure 3:
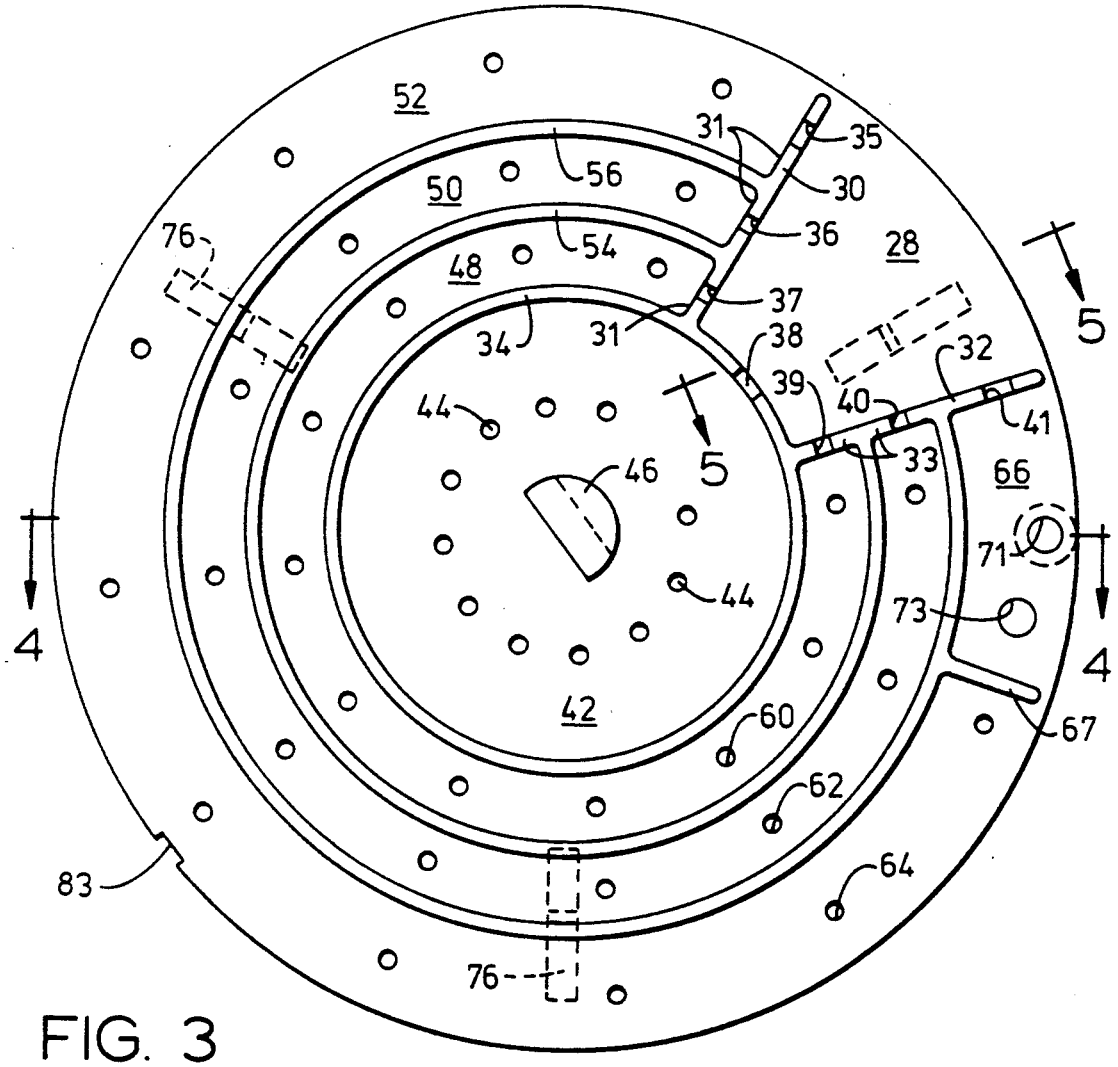
FIG. 3 is a bottom view of the distribution baffle of FIG. 2.

A plurality of coaxial distribution chambers are provided radially about center distribution chamber 42. With respect to the preferred embodiment, a first coaxial distribution chamber 48, a second coaxial distribution chamber 50, and a third coaxial distribution chamber 52 are provided as seen in FIG. 3. Coaxial distribution chambers 48 and 50 extend radially about inlet side 26 from outer surface 31 of sidewall 30 to outer surface 33 of sidewall 32, thereby leaving inlet chamber 28 intact. First coaxial distribution chamber 48 is comprised of center wall 34, a portion of sidewalls 30 and 32, inlet side 26 and a first coaxial wall 54. First coaxial distribution chamber 48 is designed so that it is aligned with slots 37 and 39 in sidewalls 30 and 32, respectively, whereby flow communication is established between inlet chamber 28 and first coaxial distribution chamber 48.

Second coaxial distribution chamber 50 likewise extends radially about distribution baffle 24 from sidewall 30 to sidewall 32. Accordingly, second coaxial distribution chamber 50 is comprised of portions of sidewalls 30 and 32, first coaxial wall 54, inlet side 26 and a second coaxial wall 56. Flow communication is established between inlet chamber 28 and second coaxial distribution chamber 50 by means of slots 36 and 40 in sidewalls 30 and 32, respectively.

Third coaxial distribution chamber 52 preferably extends radially about distribution baffle 24 from sidewall 30 to the outer surface of a sidewall 67. Since third coaxial distribution chamber 52 is about the outer periphery of distribution baffle 24, it is formed by second coaxial wall 56, a portion of sidewall 30, sidewall 67, inlet side 26 and inner surface 58 (see FIG. 5) of tank 10. Flow communication occurs between third coaxial distribution chamber 52 and inlet chamber 28 by means of slot 35 in sidewall 30.

It will be noted that openings 44, 60, 62 and 64 extending through center body 25 of distribution baffle 24 are preferably provided in center distribution chamber 42 and coaxial distribution chambers 48, 50 and 52 in such manner that they provide an even flow distribution to form piston 27. Further, it has been noted that openings 44 and 64 in center distribution chamber 42 and third coaxial distribution chamber 52, respectively, may be slightly larger than openings 60 and 62 since water is provided to center distribution chamber 42 and third coaxial distribution chamber 52 by only one slot (each) having flow communication with inlet chamber 28.

In accordance with the preferred embodiment of the invention, a separate control chamber 66 is provided on inlet side 26 of distribution baffle 24, which allows a portion of cold water jet 17 to be provided to mixing orifice 68 via a bypass tube 70 (see FIG. 1). Control chamber 66 is made up of a portion of sidewall 32, second coaxial wall 56, inlet side 26 and sidewall 67 separating third coaxial distribution chamber 52 from control chamber 66. Inner surface 58 of tank 10 serves to enclose control chamber 66 as described above for third coaxial distribution chamber 52. (It will be understood that if distribution baffle 24 does not include control chamber 66, third coaxial distribution chamber 52 will extend from outer surface 31 of sidewall 30 to outer surface 33 of sidewall 32 as described above for first and second coaxial distribution chambers 48 and 50).

Cold water flows to control chamber 66 from inlet chamber 28 through slot 41 in sidewall 32, whereupon it then flows through an opening 71 in distribution baffle 24 to bypass tube 70. Bypass tube 70 is connected to an extension 72 (see FIG. 4) positioned on outlet side 74 of distribution baffle 24. Bypass tube 70 extends through the interior of tank 10 to mixing orifice 68, whereby hot water flowing through orifice inlet 69 is mixed with cold water from bypass tube 70 before exiting outlet 20. This bypassing of cold water is used to increase the actual volume of hot water available at outlet 20. In particular, it is preferred that the cold bypass water be mixed in a 6.6:1 ratio with the hot water entering orifice inlet 69 so that it does not reduce the temperature of the outlet water below an acceptable amount. Accordingly, it is preferred that the hot water entering orifice inlet 69 be approximately 132° F., the cold water entering mixing orifice 68 through bypass tube 70 be approximately 50° F., and the resulting mixture at outlet 20 be approximately 119° F.

A vent opening 73 may also be provided in control chamber 66 to encourage excess water pressure in control chamber 66 into the interior of tank 10. This is done so as to fill tank 10 (e.g., vent air from interior of tank 10) without water exiting outlet 20. Accordingly, water is prevented from flowing through bypass tube 70 until the water level in tank 10 reaches mixing orifice inlet 69.

With respect to outlet side 74 of distribution baffle 24, a plurality of slotted engagement tabs 76 are provided which extend therefrom. These tabs 76 are utilized to engage heating tube 19, thereby promoting a tighter fit among components in tank 10 and keeping heating element 22 at a desired interval from distribution baffle 24.

Figure 4:
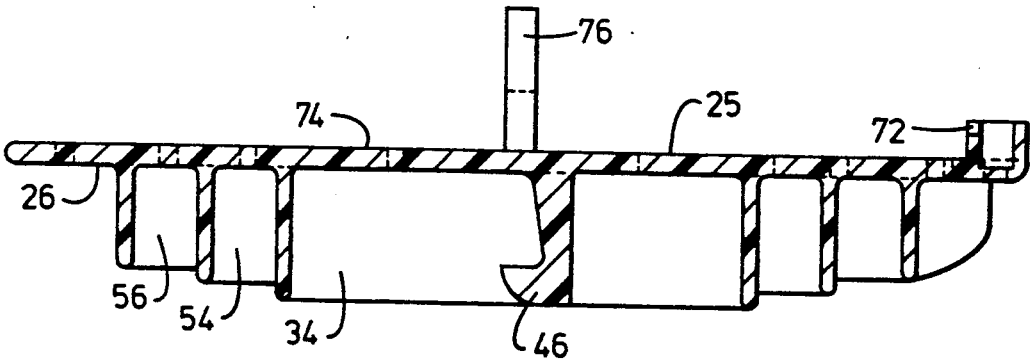
FIG. 4 is a cross-sectional view of the distribution baffle taken along line 4—4 of FIG. 3.

Distribution baffle 24 is held in place in tank 10 both about the periphery of center body 25 and at inlet side 26. The attachment of distribution baffle 24 within tank 10 is of paramount importance since leaking around the periphery of center body 25 renders distribution baffle 24 unable to perform its intended function. Specifically, the side edge of center body 25 preferably fits into a groove 78 in inner surface 58 of lower section 16 (see FIG. 5). Distribution baffle 24 is then held in place by means of a ridge 80 which is spaced so as to frictionally engage outlet side 74 of distribution baffle 24. Further, hook 46, extending from inlet side 26 of distribution baffle 24, is caused to frictionally engage a mating hook 82 extending from bottom surface 84 of tank 10 (see FIG. 1). As best seen in FIG. 4, hooks 46 and 82 are each configured in a cantilever design to include a relatively thin stem portion which extends into a head portion having a relatively horizontal engagement lip, whereby the heads of hooks 46 and 82 are pressed together until the engagement lips matingly engage.

In order to properly position distribution baffle 24 in tank 10, a locator slot 83 is provided in the side edge of center body 25, which is aligned with a vertical ridge 85 running part of the way up inside surface 58 of lower section 16. Distribution baffle 24 is then slid down the interior of the tank shell until hook 46 engages hook 82 and the side edge of center body 25 snaps into groove 78. It has been found that this process of indexing distribution baffle 24 is made easier when distribution baffle 24 is relatively cool and lower section 16 is relatively hot (recently molded). Because the components of hot water tank 10 are preferably made of molded plastic, it will be understood that various marks may be made by ejection pins but any such marks do not negatively affect the objects of the present invention. By so attaching distribution baffle 24 within tank 10, all Food & Drug Administration and National Sanitation Foundation regulations are met (which preclude the use of chlorinated hydrocarbons as glues).

Having shown and described the preferred embodiment of the present invention, further adaptations of the hot water tank and the distribution baffle for transforming a jet of high velocity inlet water to a piston can be accomplished by appropriate modifications by one of ordinary skilled in the art without departing from the scope of the invention.

I claim:

1. A hot water tank, comprising:

(a) a substantially cylindrical shell having an upper section and a lower section;

(b) a cold water inlet in said lower section;

(c) a hot water outlet in said upper section;

(d) means for heating water inside said shell; and (e) means for transforming a high velocity cold water jet entering said shell through said inlet into a piston for displacing hot water in said upper section through said outlet, whereby turbulent mixing between cold water and hot water is minimized.

2. The hot water tank of claim 1, wherein said transforming means is a distribution baffle having an inlet side with an inlet chamber, at least one distribution chamber having flow communication with said inlet chamber, and a plurality of openings through said distribution baffle enabling flow communication between said inlet side and an outlet side of said distribution baffle.

3. The hot water tank of claim 2, said distribution baffle including a control chamber on said inlet side having flow communication with said inlet chamber, said distribution baffle having an opening therethrough within said control chamber wherein a portion of said cold water jet bypasses said distribution chamber and is mixed directly with hot water prior to exiting said outlet.

4. A distribution baffle for a hot water tank, comprising:

(a) a generally disk-shaped center portion having a plurality of openings therethrough;

(b) an inlet chamber on an inlet side of said distribution baffle for receiving a high velocity jet of water; and (c) at least one distribution chamber having flow communication with said inlet chamber, said distribution chamber being aligned with said openings wherein said water flows from said inlet chamber into said distribution chamber and through said openings to form a piston.

5. The distribution baffle of claim 4, further comprising a control chamber on said inlet side in flow communication with said inlet chamber, said control chamber being aligned with one of said openings wherein a portion of said water jet bypasses said distribution chamber.

6. The distribution baffle of claim 1, further including means for affixing said baffle to the interior of said hot water tank by frictional engagement.

* * * * *